US007096610B1

(12) United States Patent
Gilmore

(10) Patent No.: US 7,096,610 B1
(45) Date of Patent: Aug. 29, 2006

(54) DIPPER ASSEMBLY INCLUDING A CLOSURE MECHANISM

(75) Inventor: Carl D. Gilmore, South Milwaukee, WI (US)

(73) Assignee: Bucyrus International, Inc., South Milwaukee, WI (US)

( * ) Notice: Subject to any disclaimer, the term of this patent is extended or adjusted under 35 U.S.C. 154(b) by 0 days.

(21) Appl. No.: 11/144,438

(22) Filed: Jun. 3, 2005

(51) Int. Cl.
*B66C 23/00* (2006.01)
*B66F 9/00* (2006.01)
*E02F 3/00* (2006.01)
*E02F 3/407* (2006.01)

(52) U.S. Cl. ..... 37/445; 414/726

(58) Field of Classification Search ..... 37/444, 37/445, 398, 394; 414/726
See application file for complete search history.

(56) References Cited

U.S. PATENT DOCUMENTS

| | | | |
|---|---|---|---|
| 1,712,040 | A | 5/1929 | Houghton |
| 2,160,432 | A | 5/1939 | Davidson |
| 2,434,902 | A | 1/1948 | Burdick |
| 2,604,221 | A | 7/1952 | Edwards et al. |
| 2,735,559 | A | 2/1956 | Burdick et al. |
| 4,006,832 | A | 2/1977 | Auxer et al. |
| 4,282,664 | A | 8/1981 | Thiele et al. |
| 4,517,756 | A | 5/1985 | Olds et al. |
| 5,613,308 | A | 3/1997 | Little |
| 5,815,958 | A | 10/1998 | Olds et al. |
| 5,815,960 | A | 10/1998 | Soczka |
| 5,974,705 | A | 11/1999 | Isley et al. |
| 6,219,946 | B1 | 4/2001 | Soczka |
| 6,467,202 | B1 | 10/2002 | Brown, Jr. |
| 6,591,521 | B1 | 7/2003 | Brown |

*Primary Examiner*—Christopher J. Novosad
(74) *Attorney, Agent, or Firm*—Quarles & Brady LLP

(57) ABSTRACT

A dipper assembly includes a dipper, a dipper door, ands a closure mechanism. The dipper door is pivotally linked relative to the dipper, and has a closed position in which the dipper door closes the open bottom. The closure mechanism has a lock position and an unlock position, and is fixed relative to the dipper and linked to the dipper door. In the lock position, the closure mechanism holds the dipper door in the closed position. In the unlock position, the closure mechanism allows the dipper door to swing away from the closed position.

19 Claims, 4 Drawing Sheets

DIPPER ASSEMBLY INCLUDING A CLOSURE MECHANISM

CROSS REFERENCES TO RELATED APPLICATIONS

Not Applicable.

STATEMENT REGARDING FEDERALLY SPONSORED RESEARCH

Not Applicable.

TECHNICAL FIELD

This invention relates to dippers for large mining shovels, and particularly to a dipper assembly including a closure mechanism that locks the dipper door in a closed position closing the bottom of the dipper.

DESCRIPTION OF THE BACKGROUND ART

Shovel dippers are formed with teeth at their leading edge and a dipper door that normally closes the rear of the dipper to hold earth and other materials that are loaded into the dipper by the action of the shovel. The dipper door must be held closed while the dipper is being loaded and while the load in the dipper is swung to a deposit point. At that point, the dipper door must be opened to allow the contents of the dipper to fall out. Typically, the locking of the dipper door has been accomplished by a mechanical latch proximal a cutting face of the dipper. The mechanical latch holds the door in a closed position, and is released by a cable or trip wire rope to allow the door to swing open under its own weight and the weight of the contents of the dipper. The door is relatched by allowing it to swing closed by virtue of its own weight and the changing attitude of the dipper as the dipper rotates back in preparation for its next loading cycle. An example of such a mechanical latch is found in U.S. Pat. No. 5,815,958 issued Oct. 6, 1998, for "Excavator Dipper Latch Assembly Having Removable Tapered Latch Bar".

The existing latching mechanisms include a latching keeper and striking plate which must be located on the front wall of the dipper in order to engage a latch bar mounted within the confines of the dipper door. The front wall of the dipper forms the cutting face of the dipper and is subjected to extreme abuse as the dipper cuts into the earth. As a result, the existing mechanical latching mechanisms are subjected to false door release or failure to latch due to fouling caused by rocks and dirt being lodged into the latchkeeper mechanism. Moreover, the constant abuse caused by the latch mechanism being on the dipper cutting face results in excessive wear and resulting high maintenance costs and efforts.

SUMMARY OF THE INVENTION

The present invention provides a dipper assembly including a dipper, a dipper door, ands a closure mechanism. The dipper door is pivotally linked relative to the dipper, and has a closed position in which the dipper door closes the open bottom. The closure mechanism has a lock position and an unlock position, and is fixed relative to the dipper and linked to the dipper door. In the lock position, the closure mechanism holds the dipper door in the closed position. In the unlock position, the closure mechanism allows the dipper door to swing away from the closed position. In one embodiment of the present invention, the closure mechanism is linked to the dipper door proximal a back edge of the door. In another embodiment, the closure mechanism is linked to the dipper door by a link. In yet another embodiment, the closure mechanism is mounted to the back wall of the dipper.

A general objective of the present invention is to provide a dipper assembly having a closure mechanism that is not easily fouled when in use, This objective is accomplished by linking the dipper door proximal a back edge of the door, linking the closure mechanism to the dipper door by a link, and/or mounting the closure mechanism to a back wall of the dipper. As a result, the historical latching mechanisms connecting the bottom edge of the dipper door to the dipper front are eliminated.

The foregoing and other objectives and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DETAILED DESCRIPTION OF THE PREFERRED EMBODIMENTS

Figure 1:
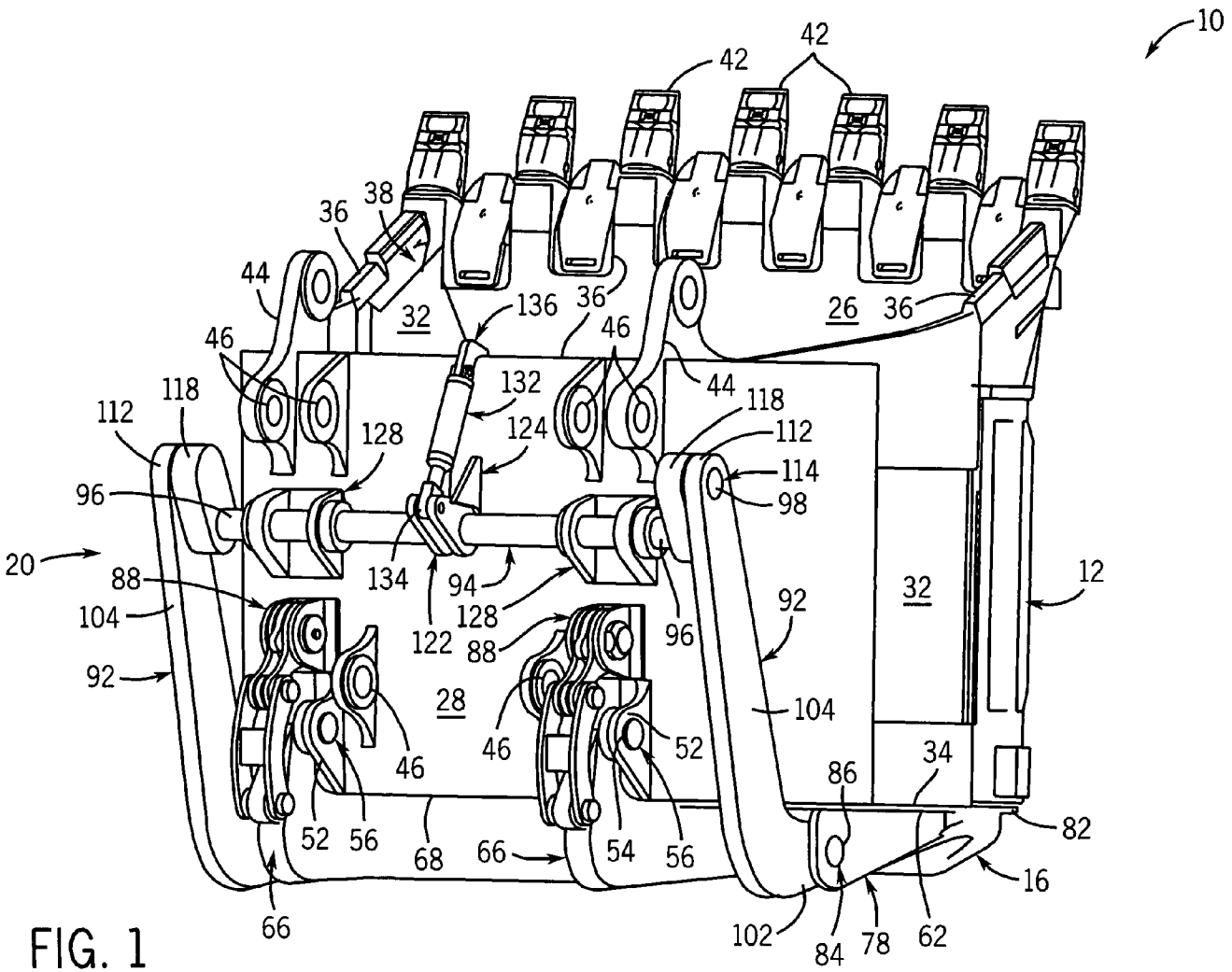
FIG. 1 is a back perspective view of a dipper assembly incorporating the present invention with a dipper door in a closed position.

Referring to FIGS. 1–4, a dipper assembly 10 includes a dipper 12 having an open dipper bottom 14 closed by a pivotally mounted dipper door 16. The dipper door 16 is locked in a closed position (shown in FIGS. 1 and 2) covering the open dipper bottom 14 by a continuously engaged closure mechanism 20. The closure mechanism 20 is mounted away from a cutting face 22 of the dipper 12 which minimizes fouling by dirt forced into the closure mechanism 20 as the dipper 12 cuts into the ground.

As is known, the dipper 12 has a front wall 26 and a back wall 28 joined by side walls 32. Rearward edges 34 of the walls 26, 28, 32 define the open dipper bottom 14 that can be closed by the dipper door 16. Forward edges 36 of the walls 26, 28, 32 define an open forward end 38 of the dipper 12 through which the dipper is filled. Teeth 42 extending forwardly of the front wall 26 forward edge 36 define a cutting edge that cuts into the ground to fill the dipper 12 with dirt, rocks, and the like. Dipper mounting lugs 44 extending from the dipper back wall 268 proximal the back wall forward edge 36 include apertures 46 that receive mounting pins (not shown) to mount the dipper 12 to a dipper arm (not shown) extending from a shovel (not shown). Dipper door mounting lugs 52 extending from the back wall 28 proximal the back wall rearward edge 34 include apertures 54 that receive pivot pins 56 that pivotally connect the dipper door 16 relative to the dipper 12 for pivotal movement about a pivot axis 58 defined by the pivot pins 56.

The dipper door 16 is pivotally connected to the dipper 12, and includes a bottom wall 62 which closes the dipper bottom 14 in the closed position. The bottom wall 62 loosely abuts the rearward edges 34 of the dipper walls 26, 28, 32 to close the dipper bottom 14. Although a substantially planar dipper door 16 is disclosed, the dipper door 16 can define a volume which abuts the rearward edges 36 of the dipper walls 26, 28, 32 to close the dipper bottom 14 without departing from the scope of the invention. Moreover, the dipper door 16 can extend into a volume defined by the dipper walls 26, 28, 32 to close the open dipper bottom without departing from the scope of the invention.

A pair of L-shaped dipper door lugs 66 extend from a back edge 68 of the dipper door 16 past the dipper door back wall 28 rearward edge 34 and toward the forward edge 36 of the dipper back wall 28 to mate with the dipper door mounting lugs 52 on the dipper 12. A dipper door lug aperture 72 formed through a distal end 74 of each dipper door lug 66 is aligned with the one of the dipper door mounting lug apertures (not shown) formed through the dipper door mounting lugs 52. One of the pivot pins 56 extends through each set of aligned dipper door lug apertures 72 and dipper door mounting lug apertures to pivotally connect the dipper door 16 relative to the dipper 12.

Side lugs 78 spaced from the dipper door lugs 66 toward a front edge 82 of the dipper door 16 includes apertures 84 that receive side lug pins 86 to pivotally connect the closure mechanism 20 to the dipper door 16. The apertures 84 are located between the back edge 68 and front edge 82 of the dipper door 16, such that when the dipper door 16 is in the closed position, the apertures 84 are disposed within a volume extending from the dipper walls 26, 28, 32. Preferably, the side lugs 78 are proximal the back edge 68 of the dipper door 16 away from the cutting face 22 of the dipper 12 to prevent excessive wear on the closure mechanism 20 connected to the side lugs 78.

Figure 2:
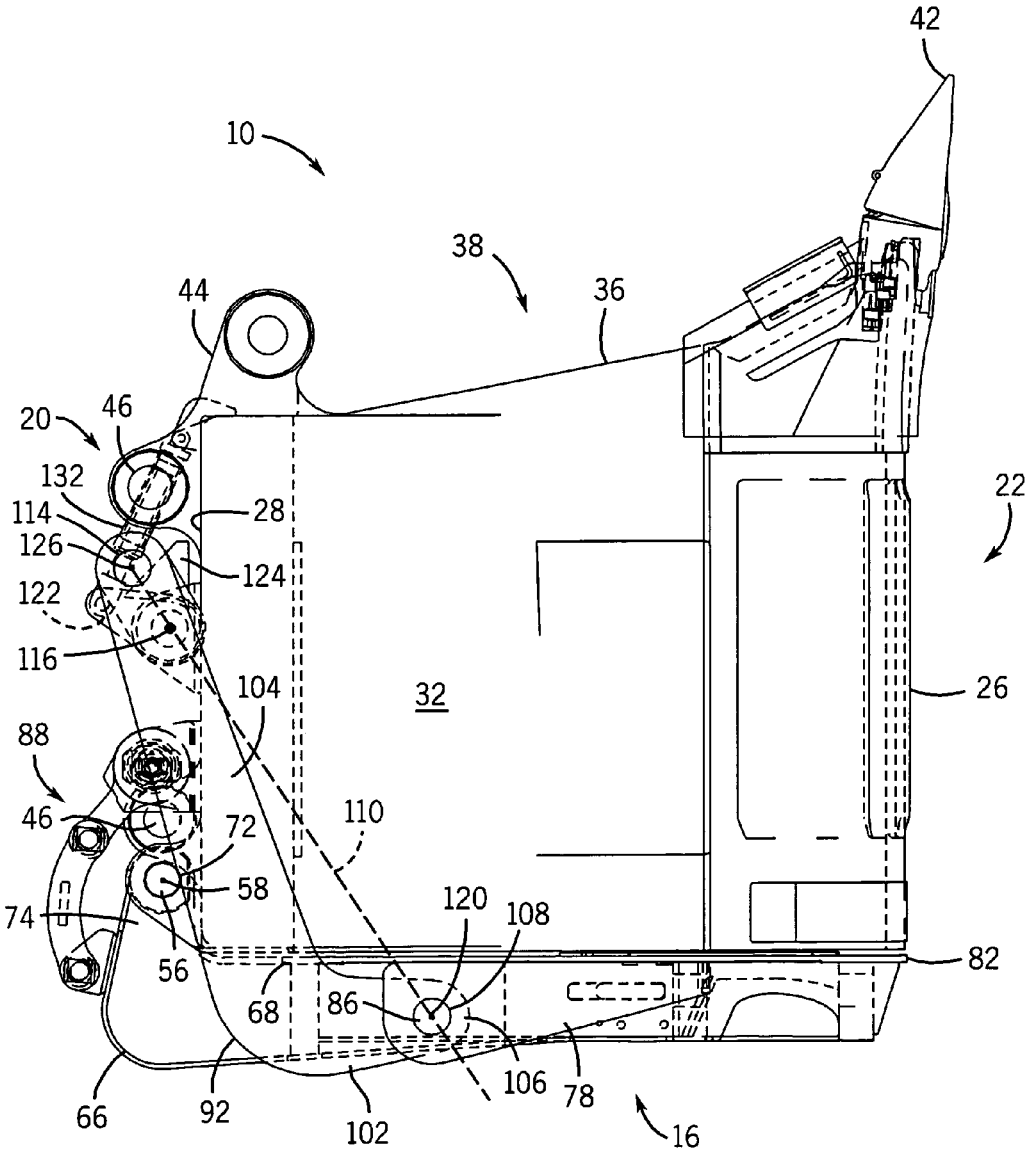
FIG. 2 is a side view of the dipper assembly of FIG. 1.
Figure 3:
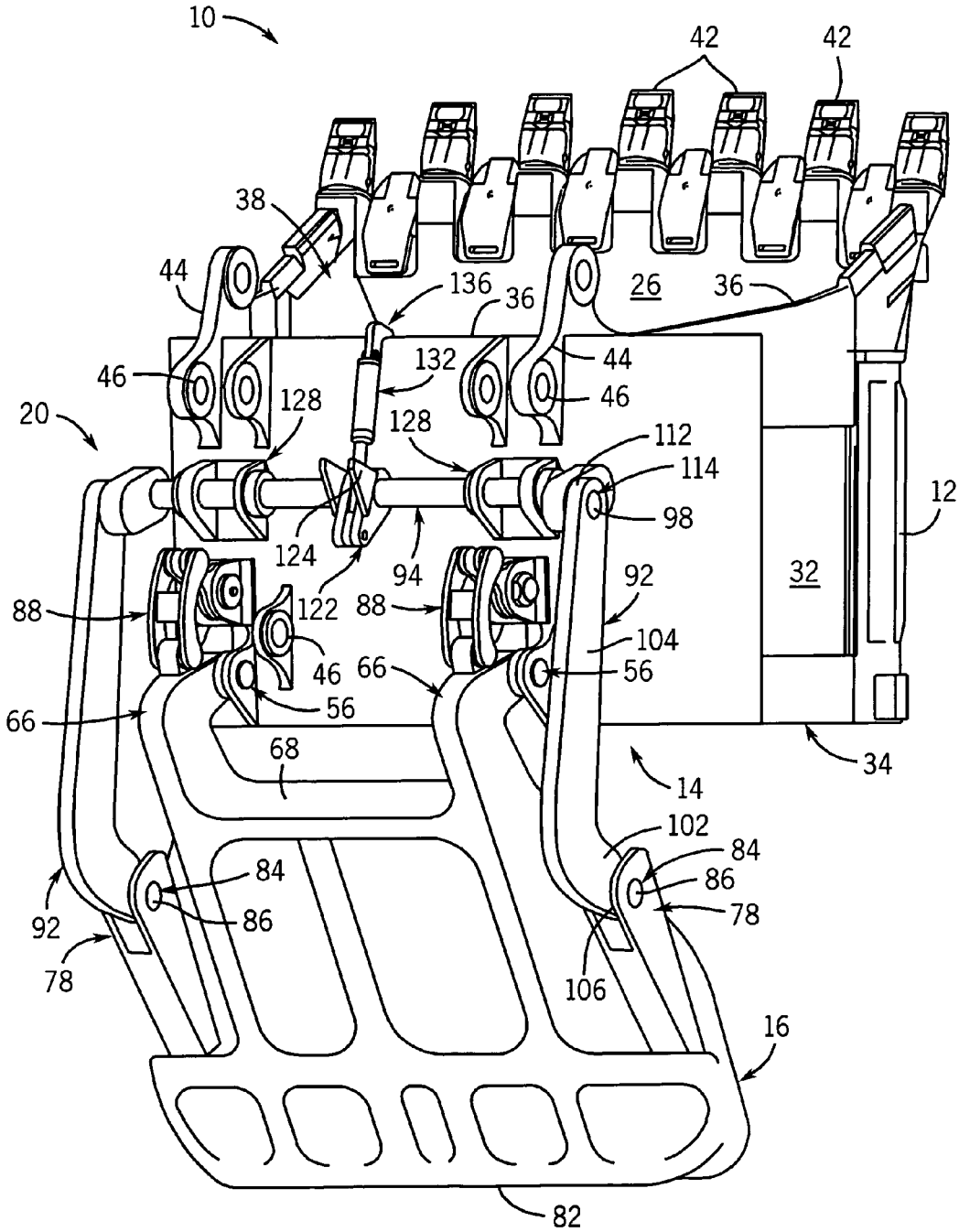
FIG. 3 is a back perspective view of the dipper assembly of FIG. 1 with the dipper door in an open position.
Figure 4:
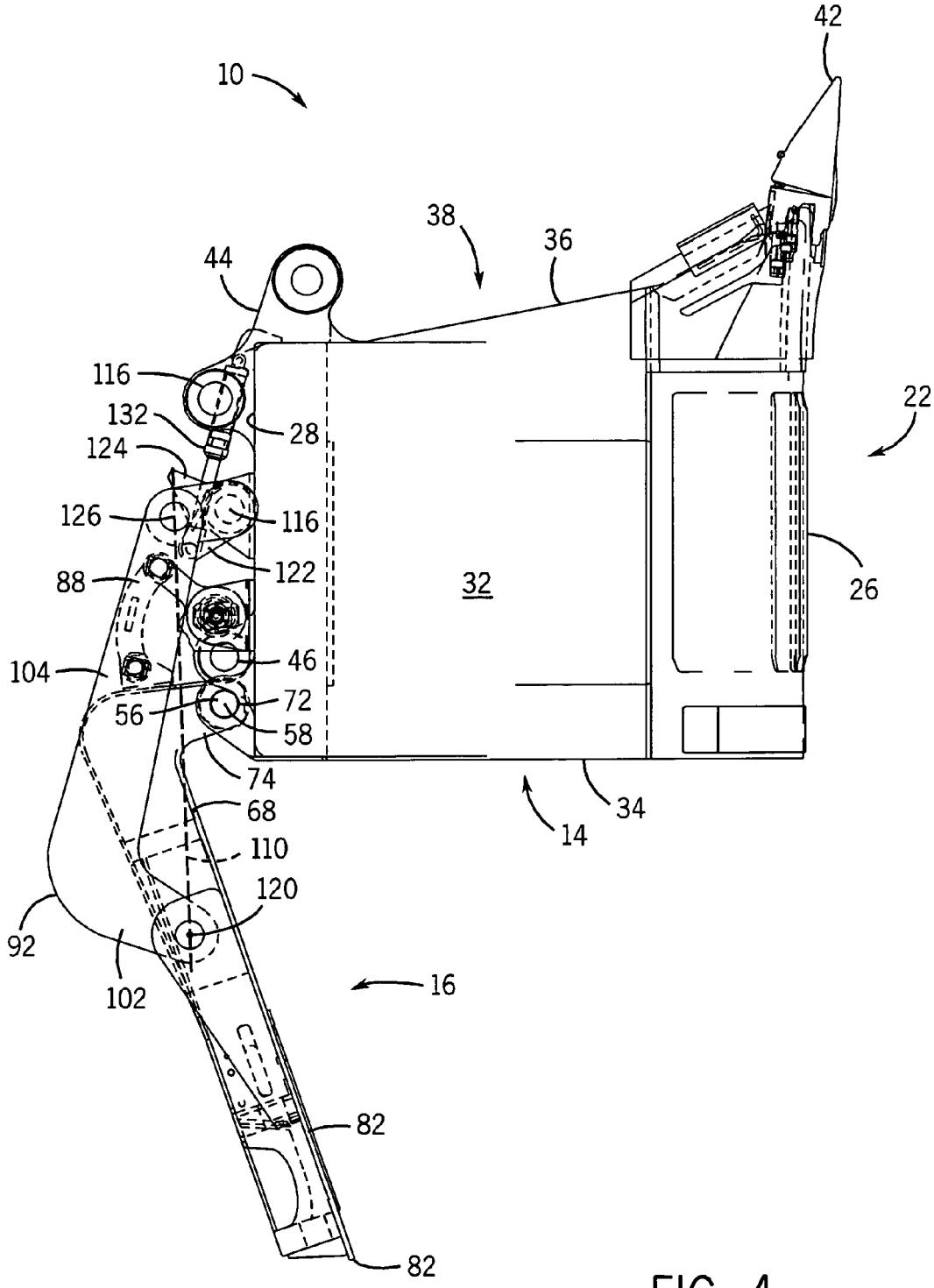
FIG. 4 is a side view of the dipper assembly of FIG. 3.

The dipper door 16 is locked in the closed position (shown in FIGS. 1 and 2) by the closure mechanism 20 in a locked position (shown in FIGS. 1 and 2). When the closure mechanism 20 is moved to an unlock position (shown in FIGS. 3 and 4), the dipper door 16 freely pivots about the pivot axis 58 and freely swings away from the open dipper bottom 14 toward an open position (shown in FIGS. 3 and 4) to discharge the load in the dipper 12. Snubbers 88 mounted on the dipper back wall 28 engage the dipper door lugs 66 and dampen the free swinging motion of the dipper door 16 as the dipper door 16 swings from the open position toward the closed position.

The closure mechanism 20 includes a pair of parallel spaced L-shaped links 92 that are moveable between a lock position (shown in FIGS. 1 and 2) in which the links 92 hold the dipper door 16 in the closed position closing the dipper bottom 14 and an unlock position (shown in FIGS. 3 and 4) in which the links 92 allow the dipper door 16 to pivot about the pivot axis 58 away from the open dipper bottom 14. The links 92 are moved between the lock position and unlock position by offset crank pins 98 mounted on the ends 96 of a rotatable cross shaft 94 extending between the links 92. Each offset crank pin 98 pivotally connects one of the links 92 to the cross shaft 94.

Each link 92 has a first leg 102 joined to a second leg 104 at an angle to form the L-shaped link 92. When the dipper door 16 is in the closed position, the link 92 wraps around the back wall 28 rearward edge 34 with the first leg 102 extending beneath the dipper back wall 28 rearward edge 34 toward one of the side lugs 78 and the second leg 104 extends forwardly toward the back wall 28 forward edge 36. The first leg 102 terminates at a first end 106 having an aperture aligned with the apertures 84 formed in one of the side lugs 78. One of the side lug pins 86 extends through the aligned first end aperture and side lug aperture 84 to pivotally connect the first end 106 of the link 92 to the dipper door 16. The second leg 104 terminates at a second end 112 having an aperture 114 to pivotally connect the second end 112 to the offset crank pin 98. Although, an L-shaped link 92 having a second leg 104 longer than the first leg 102 is shown, the link 92 can be having any shape, such as straight, L-shaped having a second leg equal to or shorter than the first leg, and the like, without departing from the scope of the invention.

Each axially extending offset crank pin 98 is fixed relative to one end 96 of the cross shaft 94 and has a longitudinal axis 126 radially offset from, and parallel to, the cross shaft axis 116 of rotation by a crank body 118. The offset crank pin 98 is received in one of the second end apertures 114 to pivotally connect the link 92 to the cross shaft 94. The cross shaft 94 rotates to move the pin 98 a limited arc distant between a lock position (shown in FIGS. 1 and 2) and an unlock position (shown in FIGS. 3 and 4). In the lock position, the pin 98 is spaced a first distance away from the back wall 28 rearward edge 34 to pull the link 92 forwardly, and thus the dipper door 16 toward the dipper wall rearward edges 34, such that the dipper door 16 cannot pivot about the pivot axis 58 and swing freely away from the closed position. In the unlock position, the pin 98 is spaced a second distance away from the back wall 28 rearward edge 34 to move the link 92 rearwardly and allow the dipper door 16 to pivot about the pivot axis 58 and swing freely away from the closed position toward the open position. The first distance is greater than the second distance, such that in the lock position, the link 92 is in tension to hold the dipper door 16 in the closed position.

The cross shaft 94 is rotatably fixed relative to the dipper 12 by brackets 128 fixed to the dipper back wall 28 using methods known in the art, such as welding. A lever arm 122 fixed to the cross shaft 94 approximately midway between the offset crank pins 98 extends radially from the cross shaft 94. A stop arm 124 protruding from the lever arm 122 engages the dipper back wall 28 to limit rotation of the cross shaft 94 and stop the cross shaft 94 in the lock position. Advantageously, the stop arm 124 prevents the cross shaft 94 from over rotating and unintentionally allowing the links 92 to move to the unlock position. Of course, other methods for preventing over rotation of the cross shaft 94 can be used, such as sizing the crank body 118 to engage a stop or the dipper back wall 28, without departing from the scope of the invention.

Preferably, the closure mechanism 20 is self-locking by locating the lock position of the offset crank pin 98 past an over-center position, such that a line 110 extending through the offset crank pin axis 126 and the link pin axis 120 passes between the axis 116 of rotation of the cross shaft 94 and the back wall 28. As a result, the weight of the door 16 holds the stop arm 124 against the back wall 28 until the cross shaft 94 is rotated to move the offset crank pin 98 away from the back wall 28 back over the over center position toward the unlock position and allow the dipper door 16 to pivot about the pivot axis 58. Once the cross shaft 94 is urged back over the over center position toward the unlock position, such that the axis 116 of rotation of the cross shaft 94 passes between the line 110 extending through the offset crank pin axis 126 and the link pin axis 120 and the back wall 28, the weight of the dipper door 16 and the contents of the dipper 12 opens the dipper door 16 without further external forces.

The cross shaft 94 is rotated by a hydraulic actuator 132 which moves the lever arm 122 to rotate the cross shaft 94 and move the links 92 between the lock position and the unlock position. The actuator 132 includes one end 134 fixed to the lever arm 122 and an opposing end 136 fixed to the dipper 12, and is controlled by the shovel operator from within the shovel. Of course, other mechanisms can be used to move the lever arm 122, such as a dipper trip wire rope used on conventional latch mechanisms which pulls the lever toward the unlock position until the weight of the dipper door 16 and contents within the dipper 12 continue the rotation of the cross shaft 94 and allow the dipper door 16 to pivot about the pivot axis 58, without departing from the scope of the invention. Advantageously, by providing a closure mechanism having a lock position of the offset crank pin 98 past an over-center position the force required to release the dipper door 16 for opening the dipper 12 is greatly reduced. As a result, the size of the actuator 132 can be minimized.

In operation, movement of the dipper arm permits the dipper door 16 to swing toward the closed position. The swinging dipper door 16 forces the links 92 forwardly which rotates the cross shaft 94 until the line 110 extending through the offset crank pin axis 126 and link pin axis 120 is between the axis 116 of rotation of the cross shaft 94 and the back wall 28 and the swinging dipper door 16 is stopped by the dipper 12 and/or the stop arm 124 engages the dipper back wall 28 and stops the offset crank pin 98 and link 92 in the lock position. Once the offset crank pin 98 and link 92 are in the lock position, the dipper door 16 is locked in the closed position.

The dipper door 16 is opened by actuating the actuator 132 which urges the lever arm 122, and thus the stop arm 124, away from the dipper back wall 28 to rotate the cross shaft 94 and move the offset crank pin 98 toward the unlock position. Advantageously, once the offset crank pin 98 is urged past the over center position (i.e. the cross shaft axis 116 of rotation is between the line 110 extending between the offset crank pin axis 126 and the link pin axis 120) the weight of the dipper door 16 and contents of the dipper 12 pull the link 92 further rearwardly, continuing the rotation of the cross shaft 94, until the dipper door 16 can pivot about the pivot axis 58 and swing freely, against the dampening effect of the snubbers 88, toward the open position.

In the embodiment described above, the closure mechanism is located away from the normal flow of material being dug and dumped by the dipper assembly. This results in a level of reliability not previously possible. Moreover, the particular self-locking feature of the above described embodiment provides the additional benefit of requiring low forces to release the dipper door from the closed position.

While there has been shown and described what are at present considered the preferred embodiments of the invention, it will be obvious to those skilled in the art that various changes and modifications can be made therein without departing from the scope of the invention defined by the appended claims.

The invention claimed is:

1. A dipper assembly comprising:

a dipper having an open bottom;

a door pivotally linked relative to said dipper, said door having a closed position in which said door closes said open bottom; and a closure mechanism movable between a lock position and an unlock position, said closure mechanism including at least one link pivotally connected relative to said door, a crank body rotatable about an axis of rotation, and a crank pin extending from said crank body and pivotally connected to said link, said crank pin having a longitudinal axis offset from said axis of rotation of said crank body, wherein rotation of said crank body about said axis of rotation in one direction moves said crank pin an arc distance which urges said link toward said lock position to hold said door in said closed position, and rotation of said crank body about said axis of rotation in an opposing direction moves said crank pin an arc distance which urges said link toward said unlock position to allow said door to swing away from said closed position, wherein said crank body is rotatably fixed to a shaft, and rotation of said shaft about said axis of rotation causes said link to move between said lock position and said unlock position.

2. The dipper assembly as in claim 1, in which said dipper includes a front wall spaced from a back wall by said open bottom, and in said closed position, a back edge of said door is proximal said dipper back wall and a front edge of said door is proximal said dipper front wall, and said link is pivotally fixed relative to said door proximal a back edge of said door.

3. The dipper assembly as in claim 2, in which said a closure mechanism includes at least one link pivotally connected relative to said door, said crank body rotatable about said axis of rotation, and a crank pin extending from said crank body and pivotally connected to said link, said crank pin having a longitudinal axis offset from said axis of rotation of said crank body, wherein rotation of said crank body about said axis of rotation in one direction moves said crank pin an arc distance which urges said link toward said lock position to hold said door in said closed position, and rotation of said crank body about said axis of rotation in an opposing direction moves said crank pin an arc distance which urges said link toward said unlock position to allow said door to swing away from said closed position.

4. The dipper assembly as in claim 3, in which rotation of said crank body about said axis of rotation in said one direction moves said crank pin an arc distance past an over center position, such that said closure mechanism is self-locking.

5. The dipper assembly as in claim 3, in which in said closed position, a back edge of said door is proximal said dipper back wall, and a front edge of said door is proximal said dipper front wall, and said link is pivotally fixed relative to said door proximal a back edge of said door.

6. The dipper assembly as in claim 3, in which said link is L-shaped having a first leg pivotally connected to said door and a second leg pivotally connected to said crank pin.

7. The dipper assembly as in claim 1, in which rotation of said crank body about said axis of rotation in said one direction moves said crank pin an arc distance past an over center position, such that said closure mechanism is self-locking.

8. The dipper assembly as in claim 1, in which said link is L-shaped having a first leg pivotally connected to said door and a second leg pivotally connected to said crank pin.

9. The dipper assembly as in claim 1, in which a lever extending transverse from said axis of rotation rotates said shaft to move said link from said lock position toward said unlock position.

10. The dipper assembly as in claim 9, in which an actuator having one end fixed relative to said lever and an opposing end fixed relative to said dipper acts on said lever to rotate said shaft and move said link from said lock position toward said unlock position.

11. A dipper assembly comprising:

a dipper having front wall spaced from a back wall by an open bottom, said front wall defining a cutting face of said dipper;

a door pivotally linked relative to said dipper back wall, said door having a closed position in which said door closes said open bottom, in said closed position a back edge of said door is proximal said dipper back wall and a front edge of said door is proximal said dipper front wall; and a closure mechanism fixed relative to said dipper and linked to said dipper door proximal a back edge of said dipper door, said closure mechanism having a lock position and an unlock position, wherein in said lock position, said closure mechanism holds said door in said closed position, in said unlock position, said closure mechanism allows said door to swing away from said closed position, in which said a closure mechanism includes at least one link pivotally connected relative to said door, a crank body rotatable about an axis of rotation, and a crank pin extending from said crank body and pivotally connected to said link, said crank pin having a longitudinal axis offset from said axis of rotation of said crank body, wherein rotation of said crank body about said axis of rotation in one direction moves said crank pin an arc distance which urges said link toward said lock position to hold said door in said closed position, and rotation of said crank body about said axis of rotation in an opposing direction moves said crank pin an arc distance which urges said link toward said unlock position to allow said door to swing away from said closed position, and said crank body is rotatably fixed to a shaft, and rotation of said shaft about said axis of rotation causes said closure mechanism to move between said lock position and said unlock position.

12. The dipper assembly as in claim 11, in which rotation of said crank body about said axis of rotation in said one direction moves said crank pin an arc distance past an over center position, such that said closure mechanism is self-locking.

13. The dipper assembly as in claim 11, in which said link is pivotally fixed relative to said door proximal a back edge of said door.

14. The dipper assembly as in claim 11, in which said link is L-shaped having a first leg pivotally connected to said door and a second leg pivotally connected to said crank pin.

15. The dipper assembly as in claim 11, in which a lever extending transverse from said axis of rotation rotates said shaft to move said closure mechanism from said lock position toward said unlock position.

16. The dipper assembly as in claim 15, in which an actuator having one end fixed relative to said lever and an opposing end fixed relative to said dipper acts on said lever to rotate said shaft and move said closure mechanism from said lock position toward said unlock position.

17. A dipper assembly comprising:

a dipper having a front wall and a back wall joined by side walls, said walls defining an open bottom;

a door pivotally linked relative to said dipper back wall, said door having a closed position in which said door closes said open bottom; and a closure mechanism mounted to said dipper back wall and linked to said dipper door, said closure mechanism having a lock position and an unlock position, wherein in said lock position, said closure mechanism holds said door in said closed position, in said unlock position, said closure mechanism allows said door to swing away from said closed position, and a crank body is rotatably fixed to a shaft, and rotation of said shaft about an axis of rotation causes said closure mechanism to move between said lock position and said unlock position.

18. The dipper assembly as in claim 17, in which a lever extending transverse from said axis of rotation rotates said shaft to move said closure mechanism from said lock position toward said unlock position.

19. The dipper assembly as in claim 18, in which an actuator having one end fixed relative to said lever and an opposing end fixed relative to said dipper acts on said lever to rotate said shaft and move said closure mechanism from said lock position toward said unlock position.

* * * * *